US010683113B2

(12) United States Patent
Mackie et al.

(10) Patent No.: US 10,683,113 B2
(45) Date of Patent: Jun. 16, 2020

(54) PASS THROUGH DEVICE FOR WRAPPING OBJECTS

(71) Applicant: 1137508 ON LTD., Scarborough (CA)

(72) Inventors: Laurie Robert Mackie, Oshawa (CA); Defu Lou, Ajax (CA)

(73) Assignee: 1137508 ON LTD., Scarborough (CA)

( * ) Notice: Subject to any disclaimer, the term of this patent is extended or adjusted under 35 U.S.C. 154(b) by 369 days.

(21) Appl. No.: 15/600,087

(22) Filed: May 19, 2017

(65) Prior Publication Data

US 2018/0334273 A1 Nov. 22, 2018

(51) Int. Cl.
*B65B 11/00* (2006.01)
*B65B 11/04* (2006.01)

(52) U.S. Cl.
CPC ..... *B65B 11/008* (2013.01); *B65B 11/00* (2013.01); *B65B 11/045* (2013.01)

(58) Field of Classification Search
CPC .... B65B 11/045; B65B 11/025; B65B 11/008
USPC ..... 53/399, 588, 441, 587
See application file for complete search history.

(56) References Cited

U.S. PATENT DOCUMENTS 4,317,322 A * 3/1982 Lancaster ..... B65B 11/008 53/399
4,553,374 A * 11/1985 Lancaster ..... B65B 11/008 53/210
4,761,934 A * 8/1988 Lancaster ..... B65B 11/025 269/139
4,930,292 A * 6/1990 Focke ..... B65B 11/008 53/263
4,953,336 A * 9/1990 Lancaster, III ..... B65B 11/008 53/176
5,027,579 A * 7/1991 Keip ..... B65B 11/008 53/133.3
6,880,316 B2 * 4/2005 Lancaster, III ..... B65B 11/008 100/13
7,827,766 B2 * 11/2010 Matsumoto ..... B65B 11/008 53/173
2002/0000079 A1 * 1/2002 Lancaster, III ..... B65B 11/008 53/588

(Continued)

*Primary Examiner* — Robert F Long
*Assistant Examiner* — Xavier A Madison
(74) *Attorney, Agent, or Firm* — Norton Rose Fulbright Canada LLP

(57) ABSTRACT

A device and corresponding systems and methods are provided for wrapping an object resting on an object conveyor defining an object path, the object conveyor conveying the object in a forward direction along the object path, the device comprising: an orbital wrapping mechanism configured to travel in an elliptical path around the object path and to deposit a stretch wrapping material; a wrapping material conveyor configured for cooperation with the object conveyor, the wrapping material conveyor positioned beneath the object conveyor such that when the orbital wrapping mechanism travels along the elliptical path, the orbital wrapping mechanism deposits the stretch wrapping material around both at least a portion of the object and at least a portion of the wrapping material conveyor, the wrapping material conveyor having at least one bearing surface in contact with the stretch wrapping material and movable in a forward direction such that the stretch wrapping material is conveyed along with the object in the forward direction.

10 Claims, 7 Drawing Sheets

(56) References Cited

U.S. PATENT DOCUMENTS

2015/0259087 A1* 9/2015 Schwartz ..... B65B 11/025
53/556

* cited by examiner

PASS THROUGH DEVICE FOR WRAPPING OBJECTS

FIELD

The present disclosure generally relates to the field of depositing wrapping material around objects, and more specifically, an improved device for wrapping objects being conveyed on an object conveyor.

INTRODUCTION

In many applications, there is a need for depositing wrapping material on objects. The wrapping material may be used to bind items (e.g., to keep them together), protect items (e.g., for transport or movement to work sites), secure items from tampering/theft, among other useful applications. The object being wrapped can be a single item or multiple items.

The wrapping material also protects against dust, moisture, and sun damage (e.g., UV damage). Where objects are wrapped tightly, there may be improved stability and individual objects may be wrapped together to form unit loads (e.g., building materials). Further, entire pallets of goods can be wrapped together (often along with the pallet itself) so that the goods can be easily transportable (e.g., the pallet provides insertion points for lifting by a forklift).

The wrapping material includes various resilient films (e.g., plastic/polymer films) that in some cases are designed for elastic recovery around an object. The wrapping material can also include materials that are loosely applied around items. In some cases, the loosely applied materials can then be "shrunk" using an external trigger (e.g., heat) to shrink around the object.

Objects being wrapped have various dimensions and sizes, and in many instances, stretch wrap equipment may need to be configured to work with a wide range of different types of objects. Some objects may be particularly fragile or easily damaged, and in such cases, there may be a practical limit as to the application of the wrapping material (e.g., too tight wrapping may ultimately damage the object).

Accordingly, wrapping materials may have different properties, such as break strength, cling, clarity, tear resistance, static discharge, among others.

From a practical, commercial viability perspective, wrapping equipment accordingly needs to be designed for flexible application. An improved wrapping equipment design is described herein that provides improvements relating to the types of objects that can be handled by the wrapping equipment.

SUMMARY

A pass-through conveyor is provided that has three belts or could have three chains and two belts. In a preferred embodiment, the belts are mounted on the sides of the conveyor at or about a 15 degrees angle. The side belts (e.g., side V-belts) flow in the opposite direction to the main conveyor belt. The side V-belts move the film along and off the bottom of the conveyor to the end of the conveyor unto the bottom of a product traveling on top of the main belt conveyor.

A purpose of the side V-belts is to move the film forward. The belts being on a 15-degree angle prevents the film from contacting the top of the belts, preventing the film to be trapped and preventing the film from moving forward. These side belts are key to the pass-through conveyor.

Various embodiments are provided herein directed to wrapping mechanisms that incorporate variations or components of the pass-through conveyor.

In accordance with one aspect, there is provided a device for wrapping an object resting on an object conveyor defining an object path, the object conveyor conveying the object in a forward direction along the object path, the device comprising: an orbital wrapping mechanism configured to travel in an elliptical path around the object path and to deposit a stretch wrapping material; a wrapping material conveyor configured for cooperation with the object conveyor, the wrapping material conveyor positioned beneath the object conveyor such that when the orbital wrapping mechanism travels along the elliptical path, the orbital wrapping mechanism deposits the stretch wrapping material around both at least a portion of the object and at least a portion of the wrapping material conveyor, the wrapping material conveyor having at least one bearing surface in contact with the stretch wrapping material and movable in a forward direction defined by the object path such that the stretch wrapping material is conveyed along with the object in the forward direction.

In accordance with another aspect, the wrapping material conveyor is a conveyor belt having a top side and a bottom side, the bottom side of the conveyor belt travelling in the forward direction and the top side of the conveyor belt travelling in a backward direction, the conveyor belt being configured to operate such that travel of the top side in the forward direction is substantially matched to the speed of travel of the object along the object path.

In accordance with another aspect, the wrapping material conveyor is at least one conveyance mechanism selected from the group of conveyance mechanisms consisting of: (a) rollers, (b) a low friction surface, and (c) treads.

In accordance with another aspect, the orbital wrapping mechanism deposits the stretch wrapping material around both the portion of object and the portion of the wrapping material conveyor with sufficient tension such that the stretch wrapping material, upon passing a terminal end of the wrapping material conveyor, contracts to wrap the object.

In accordance with another aspect, the wrapping material conveyor and the object conveyor together form an intermediate conveyor that is adapted for use in cooperation with an in-feed conveyor, the in-feed conveyor conveying the object to the intermediate conveyor for wrapping.

In accordance with another aspect, the wrapping device further comprises an aperture following the terminal end of the wrapping material conveyor; and the stretch wrapping material contracts to wrap solely the object within the aperture prior to the wrapped object engaging an exit conveyor that conveys the wrapped object to a downstream destination.

In accordance with another aspect, the wrapping material conveyor comprises a first conveyor belt and a second conveyor belt positioned to flank the object conveyor on opposite sides of the object conveyor.

In accordance with another aspect, each of the first conveyor belt and the second conveyor belt include a first bearing surface travelling in the forward direction and a second bearing surface travelling in a backward direction; and the first conveyor belt and the second conveyor belt are oriented such that only the corresponding first bearing surfaces contact the stretch wrapping material.

In accordance with another aspect, the first conveyor belt and the second conveyor belt are angled relative to a vertical axis such that corresponding bottom sections of the first conveyor belt and the second conveyor belt are angled away from the object conveyor.

In accordance with another aspect, the first conveyor belt and the second conveyor belt are both angled away at about 15 degrees from the vertical axis.

In various further aspects, the disclosure provides corresponding systems and devices, and logic structures such as machine-executable coded instruction sets for implementing such systems, devices, and methods.

In this respect, before explaining at least one embodiment in detail, it is to be understood that the embodiments are not limited in application to the details of construction and to the arrangements of the components set forth in the following description or illustrated in the drawings. Also, it is to be understood that the phraseology and terminology employed herein are for the purpose of description and should not be regarded as limiting.

Many further features and combinations thereof concerning embodiments described herein will appear to those skilled in the art following a reading of the instant disclosure.

DESCRIPTION OF THE FIGURES

In the figures, embodiments are illustrated by way of example. It is to be expressly understood that the description and figures are only for the purpose of illustration and as an aid to understanding.

Embodiments will now be described, by way of example only, with reference to the attached figures, wherein in the figures.

DETAILED DESCRIPTION

Figure 1:
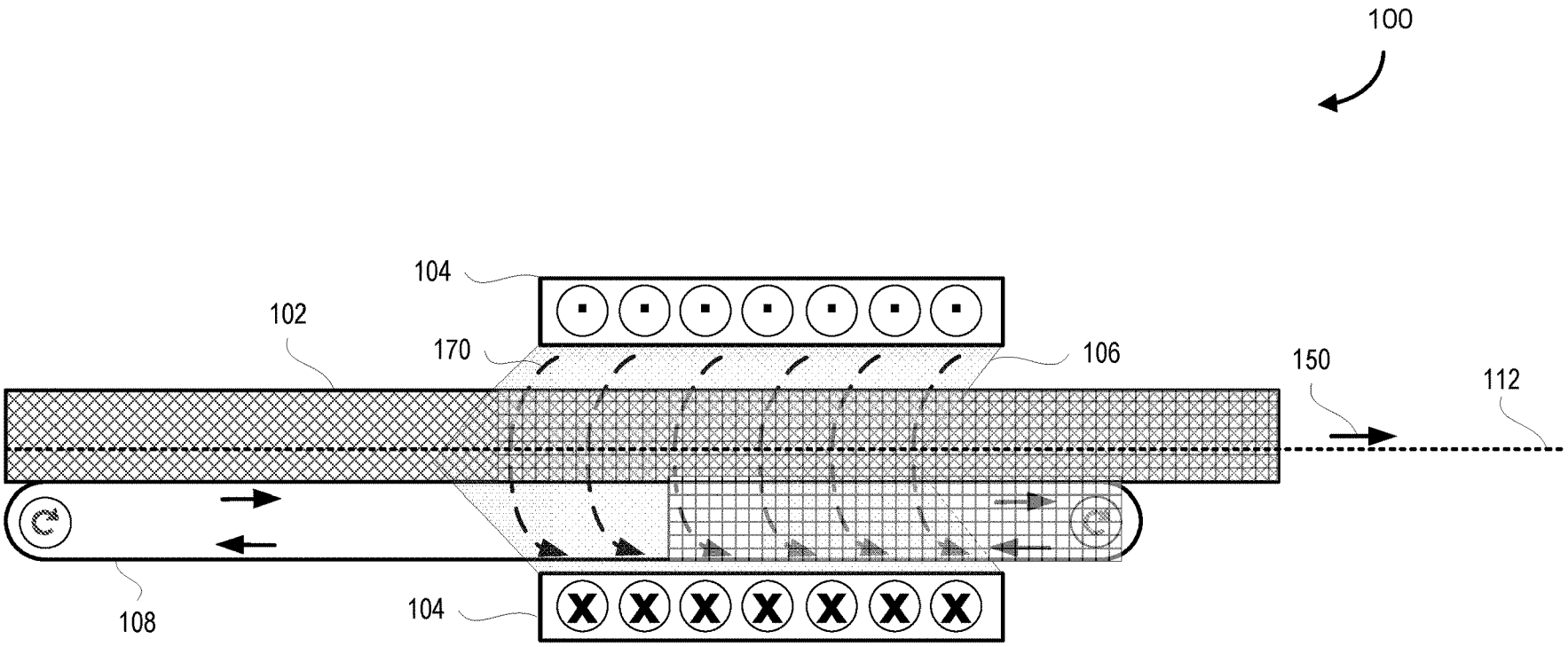
FIG. 1 is a side elevation view that illustrates an example orbital wrapping device that is configured for cooperation with a conveyance mechanism.

Embodiments of methods, systems, and apparatus are described through reference to the drawings.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Applicant is a manufacturer of wrapping equipment and produces wrapping equipment that serve a variety of purposes. The design, build, and manufacturing process of wrapping equipment can be resource intensive and accordingly, a desired objective is that a wrapping device is not only fast and efficient, but further, able to flexibly handle a variety of different objects (e.g., having different dimensions) and wrapping materials. Building wrapping equipment is technically challenging as the wrapping equipment is required to be durable and potentially handle a large volume of wrapping tasks over a duration of time.

Wrapping equipment comes in various forms, including semi-automatic, automatic, and manual forms, and there may be different types of wrapping devices such as turntables (e.g., object remains stationary, wrapping equipment orbits around the object), orbital wrapping devices (e.g., object is conveyed along a path, wrap is deposited as the object passes through the path).

Wrapping equipment can be costly, bulky and difficult to move. Object loads are typically fairly large in size (e.g., a pallet holding a plurality of individual goods, building supplies, long pieces of lumber, long pieces of steel, military materiel), and wrapping equipment is potentially larger than the object loads themselves. In some situations, the objects are multiple bundles of other objects and are prone to shifting around if subjected to longitudinal or transverse forces. In some situations, the objects may also be prone to damage and cannot be wrapped past a certain wrapping force (e.g., otherwise the objects are warped, bent, damaged).

Accordingly, the more types of objects the wrapping equipment can wrap, the more useful a particular type wrapping equipment is. As a specific example, in construction applications, wrapping equipment is important in being able to turn loads of various building materials into loads that are safe to transport, and protected as they await usage at building sites.

Furthermore, there are different types of wrapping materials (e.g., heat shrink wrap, PVC wrap, polyolefin wrap, stretch film) having different levels of quality (e.g., different thicknesses, maximum stretch, elastic properties, heat shrink properties, pre-shrink, weight, color, anti-static, vents), and correspondingly different costs. Similarly, a wider variety of wrapping material that can be used, the better as the wrapping equipment is thus more versatile in its application. There are some material characteristics that limit other physical characteristics in wrapping materials (e.g., some vented wrapping materials may be more easily torn due to the loss of structural integrity from the venting).

Proper protective packaging is important to further an object's safety and integrity, and even small deviations from applied force, etc., may impact the ability of a wrapping material to protect the object from environmental factors (e.g., insects, moisture, static, UV rays or grease) that cause undue deterioration of an object. Organizations, in some instances, such as the government and large organizations, have rigorous requirements for wrapping objects.

In the course of Applicant's business, Applicant has designed variations of orbital wrapping devices that convey objects along a conveyance means (e.g., in a forward direction).

FIGS. 1-4 describe some machines below where various challenges are encountered in the context of conveyor-based orbital wrapping devices.

Figure 3:
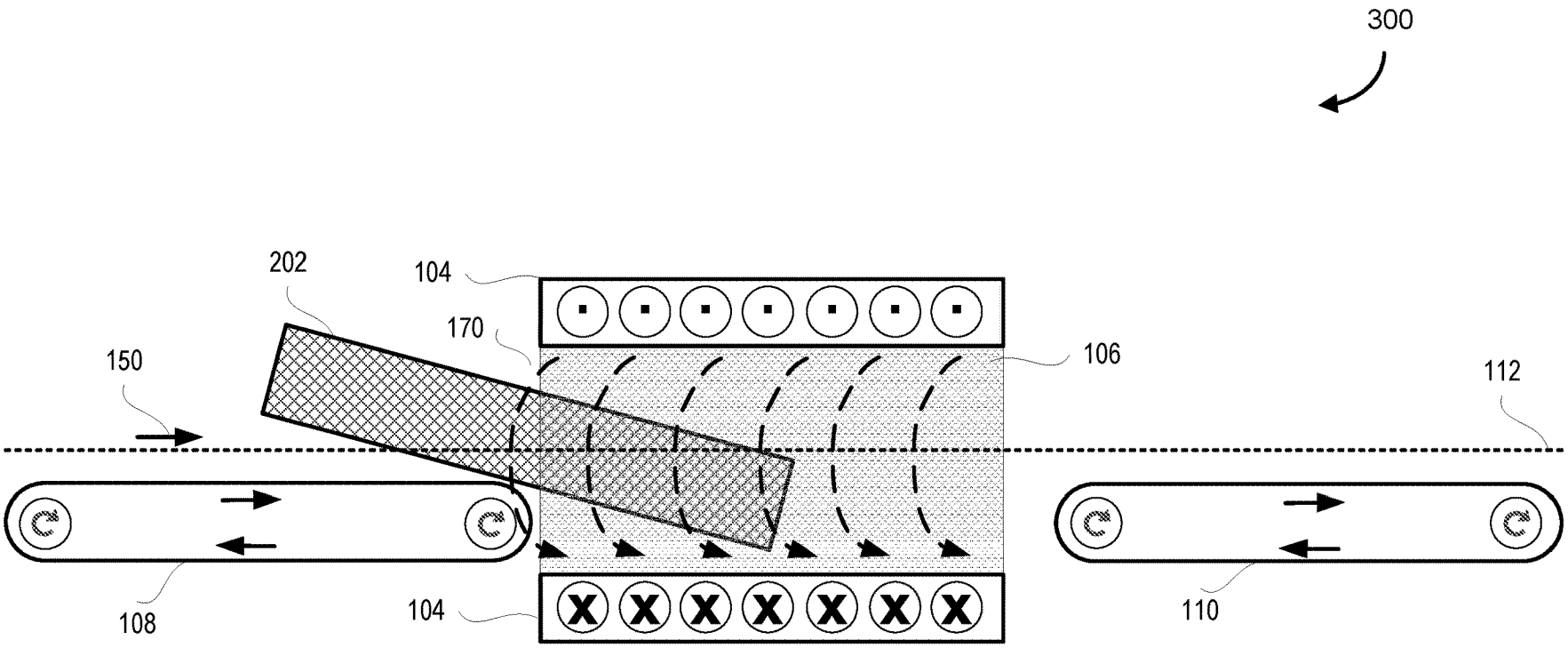
FIG. 3 is a side elevation view of a wrapping device that is provided to illustrate the use of the wrapping device when the object is too short and thus encounters difficulties in passing through the path.
Figure 4:
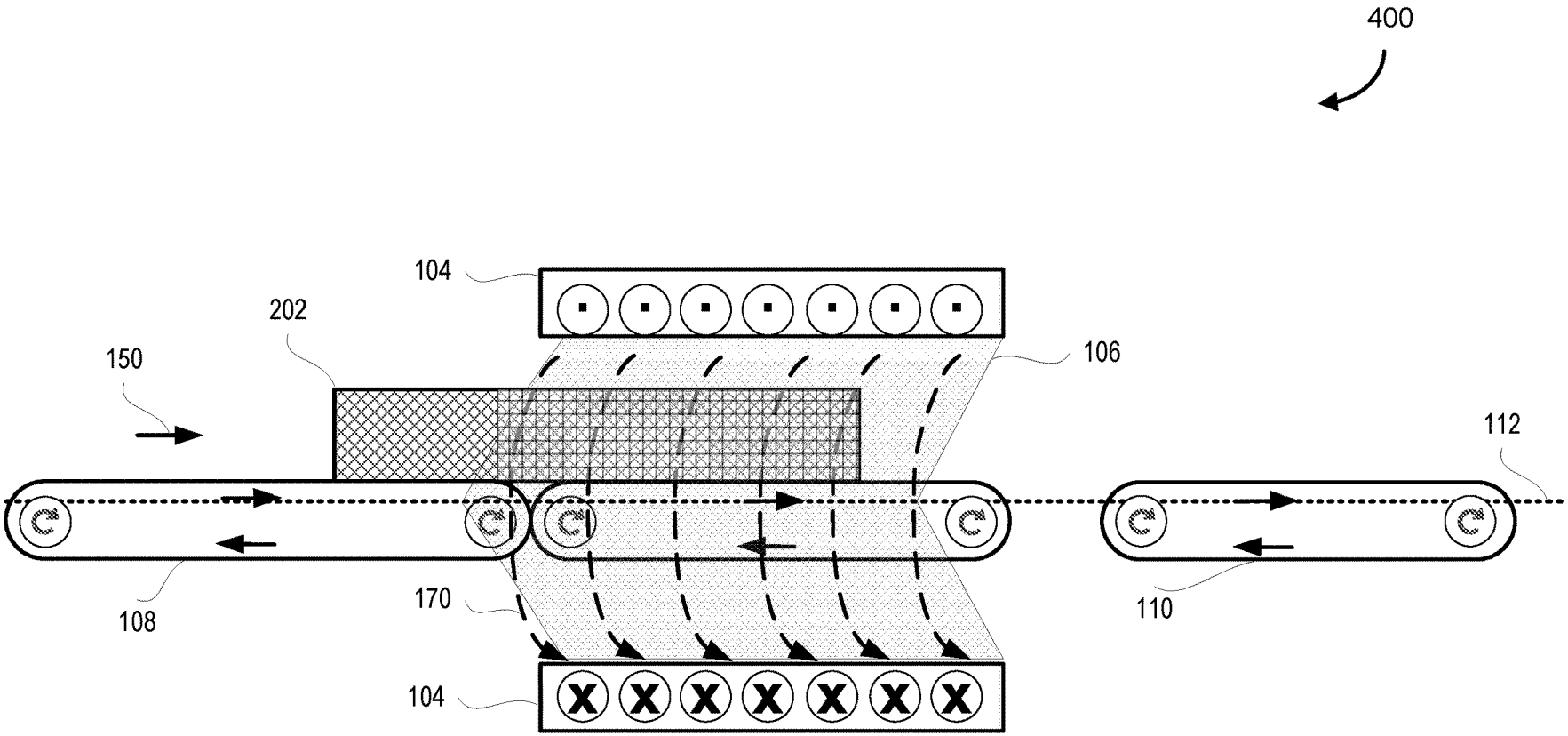
FIG. 4 is a side elevation view of a wrapping device that illustrates another design where an intermediate conveyor is provided that seeks to convey the object as it travels along the forward direction.
Figure 5:
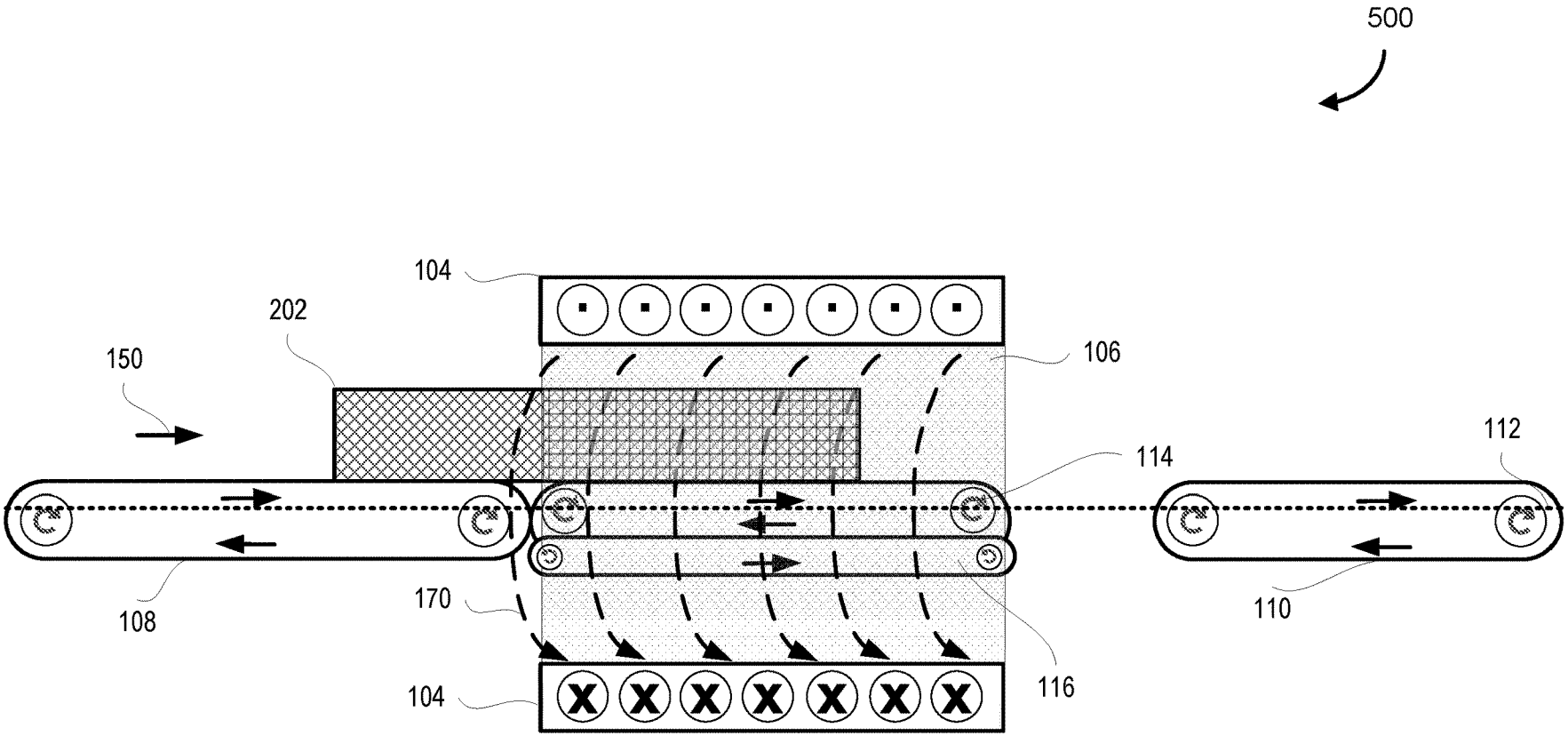
FIG. 5 is a side elevation view of an improved wrapping device where a "pass through conveyor" mechanism is provided, according to some embodiments.
Figure 6:
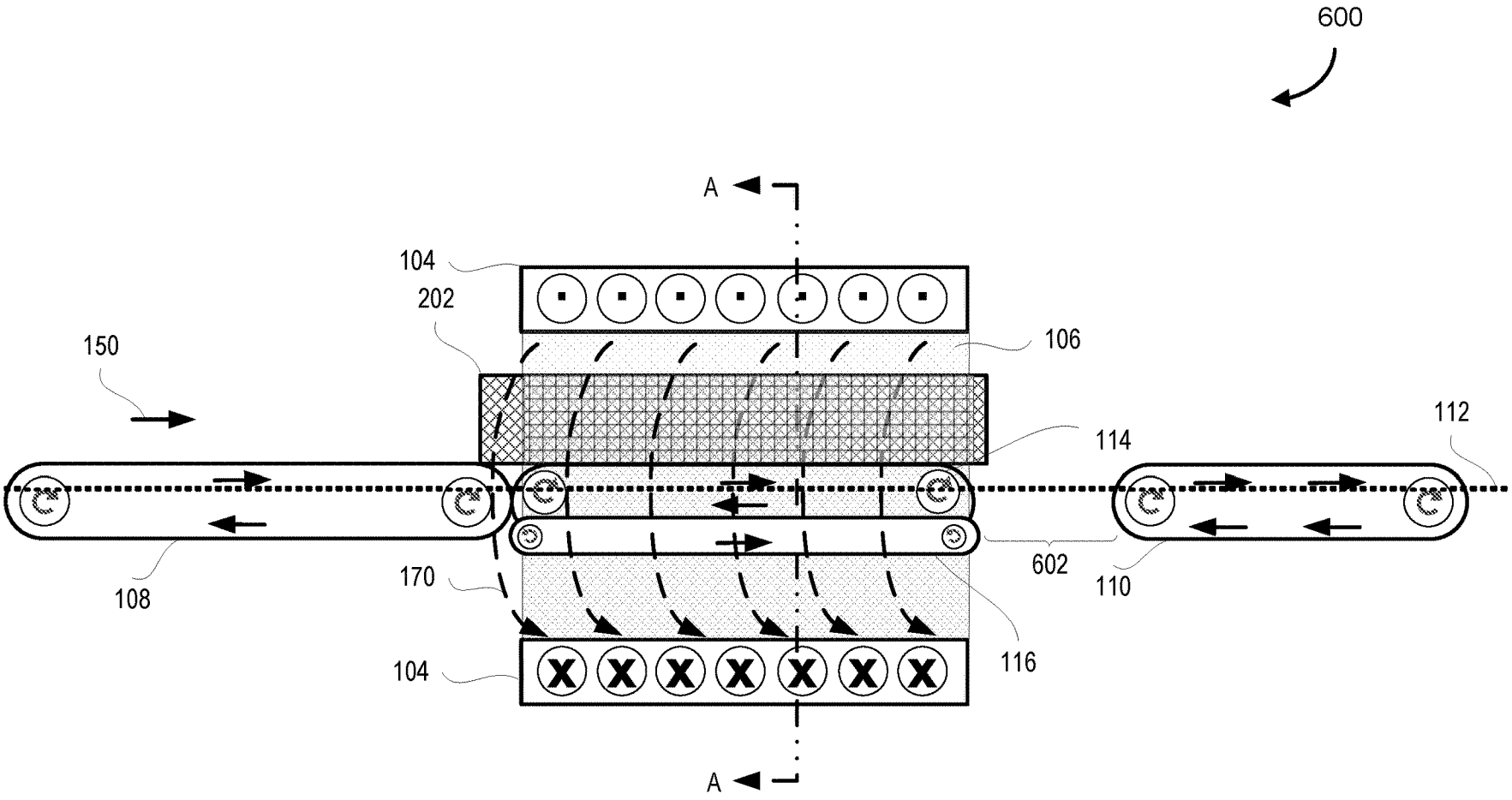
FIG. 6 is a side elevation view of the improved wrapping device of FIG. 5, but with the object in a more advanced position relative to the forward direction , according to some embodiments.
Figure 7:
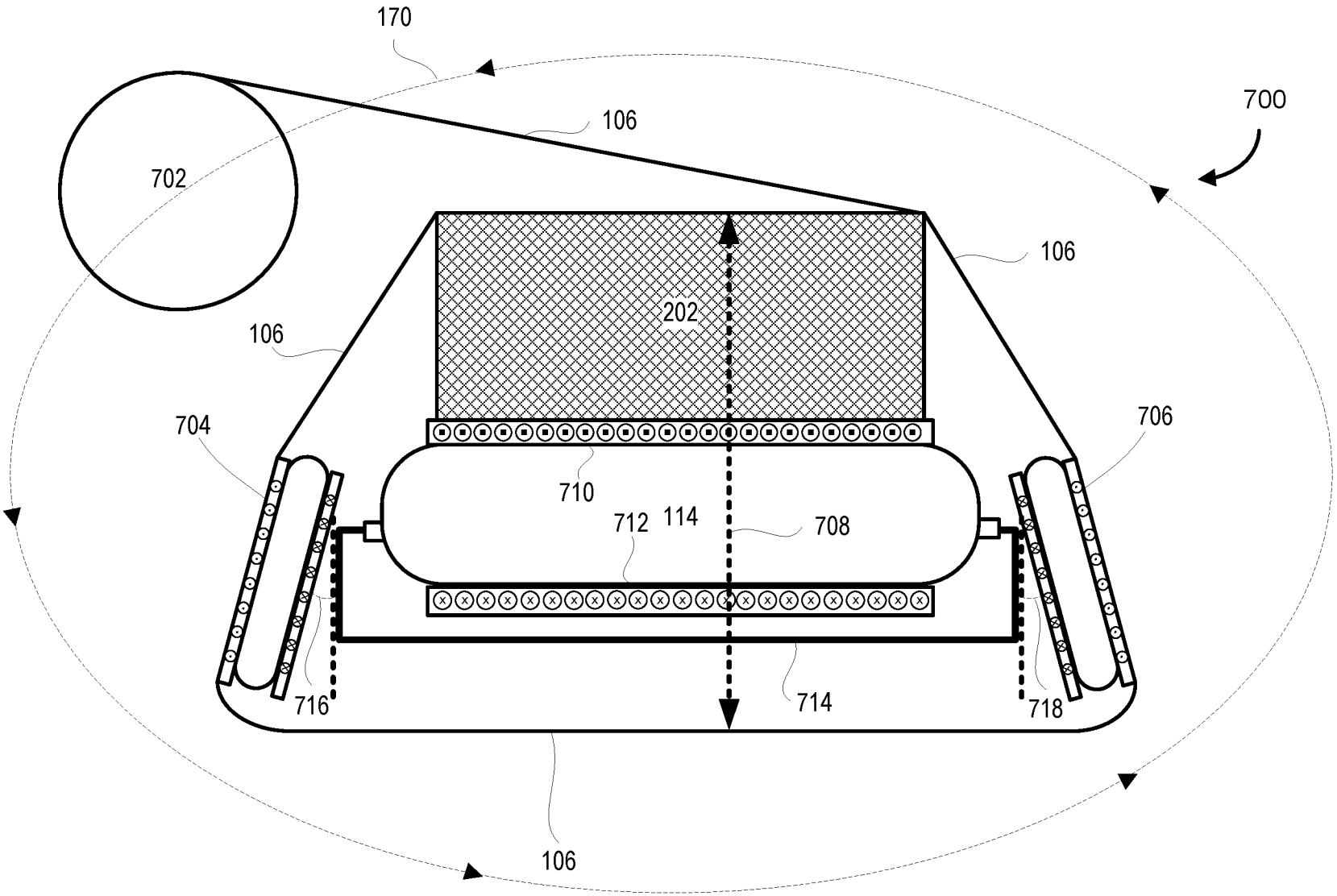
FIG. 7 is a cross sectional view of the improved wrapping device of FIG. 5, taken along lines A-A, according to some embodiments.

FIGS. 5-7 describe some embodiments of improved wrapping devices developed by the Applicant to overcome some or all of the challenges illustrated in FIGS. 1-4.

FIG. 1 is a side elevation view 100 that illustrates an example orbital wrapping device 104 that is configured for cooperation with a conveyance mechanism 108. An object 102 is conveyed along a forward direction 150 (e.g., object 102 rests on a bearing surface of the conveyance mechanism 108. In this case, the path that the object takes is in the forward direction 150.

The orbital wrapping device 104 is configured to travel in a path 170 (e.g., an elliptical path, although other paths are possible) around axis 112. As the orbital wrapping device 104 travels along the path 170, orbital wrapping device 104 is configured to deposit the wrapping material 106 around the object 102, causing the object 102 to be wrapped as the object 102 travels through the path 170 (e.g., a geometric plane or geometric planes).

In FIG. 1, a simple embodiment is illustrated wherein the wrapping material 106 is deposited around both the object 102 and the conveyance mechanism 108. As the conveyance mechanism 108 has a top bearing surface that travels in the forward direction 150, the bottom bearing surface of the conveyance mechanism 108 travels in a backwards direction.

As a result, the wrapping material 106 could be dragged backwards, and may be applied unevenly/poorly or cause damage to the object 102. While the wrapping material may ultimately be carried forward by way of adherence to the object 102 (e.g., to a gap following the conveyance mechanism 108 whereby the wrapping material 106 may, by virtue of resilience or other mechanism, "shrink" to adhere more closely to the bottom of object 102), the outcome is suboptimal.

While this example design may be useful in situations there the object is sufficiently strong and the wrapping material is selected so that it adheres tightly to the object itself and is capable of being dragged, the design may be difficult or impractical to use for other types of objects and consequently the flexibility of the device in relation to potential object types for object 102 and available wrapping materials 106 is reduced.

Figure 2:
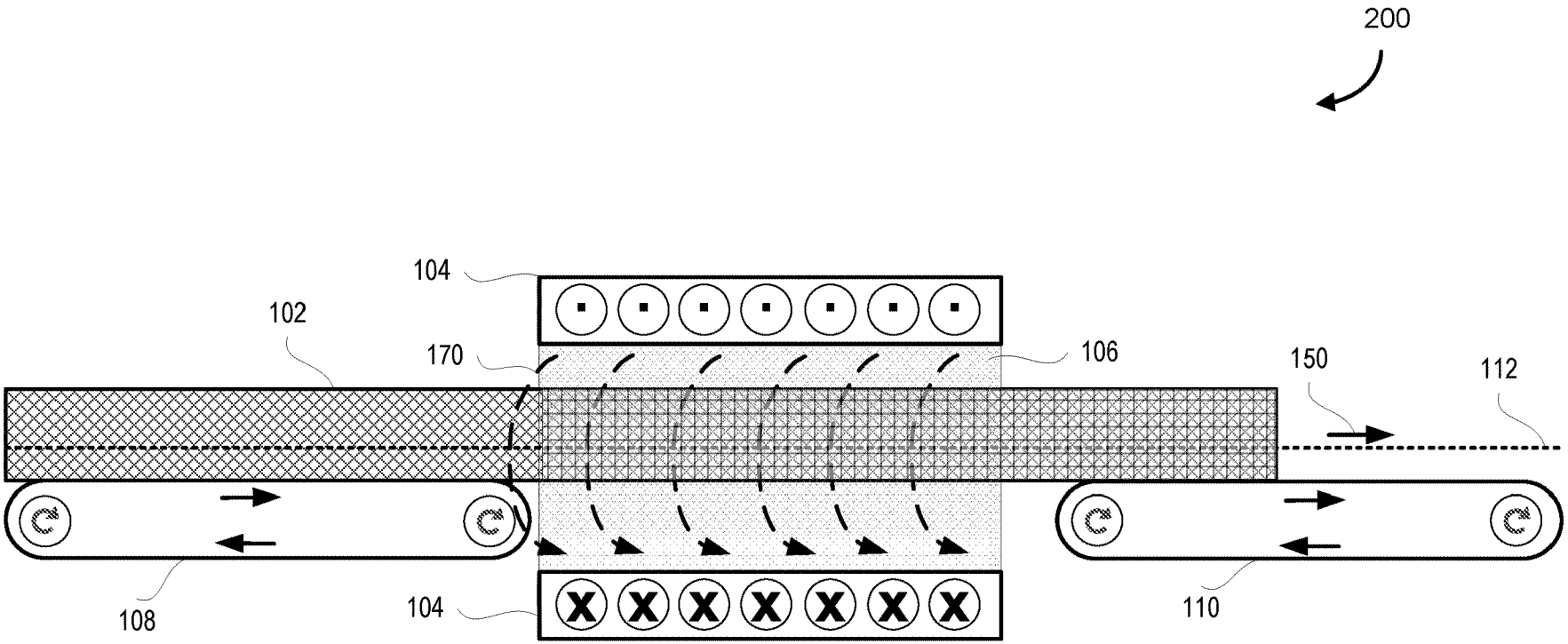
FIG. 2 is a side elevation view of a wrapping device that similarly has an orbital wrapping device that is configured for cooperation with a conveyance mechanism .

FIG. 2 is a side elevation view 200 of a wrapping device that similarly has an orbital wrapping device 104 that is configured for cooperation with a conveyance mechanism 108. In this example, the conveyance mechanism 108 ends and the orbital wrapping device 104 only wraps the object 102 itself without wrapping the conveyance mechanism 108. Accordingly, object 102 is thus wrapped as it travels along the direction 150 and through the path 170 of the orbital wrapping device 104. The wrapped object may be received by an exit conveyor 110 which takes the wrapped object 102 off to a downstream destination (e.g., for further processing, loading on transports).

However, it is important to note that for the device depicted in FIG. 2 to function, object 102 has to have sufficient structural characteristics (e.g., physical dimensions) such that it does not become adversely positioned as it is passing through the path 170. For example, if object 102 is not long enough, the object 102 may simply fall and not be received by exit conveyor 110. Object 102, even if long enough, might simply become bent if it is not resistant to bending by way of the forces encountered when cantilevered off the edge of conveyance mechanism 108.

FIG. 3 is a side elevation view 300 of a wrapping device that is provided to illustrate the use of the wrapping device when the object 202 is too short and thus encounters difficulties in passing through the path 170. The object 202 may, as a result of its insufficient length, may "tip over". In such a situation, there may be a breakdown or stoppage of the wrapping device as the object 202 may thus be struck by the orbital wrapping device 104 as it travels through path 170.

There are other potential structural characteristics aside from length that may cause object 202 to encounter obstacles in the design of FIGS. 2 and 3. For example, object 202 may be soft and thus "bend" due to gravity, or object 202 may have insufficient resistance to shearing and may be otherwise damaged as it is cantilevered. There are some object loads that may be particularly brittle and easily damaged in view of this type of loading (e.g., glass objects).

FIG. 4 is a side elevation view 400 of a wrapping device that illustrates another design where an intermediate conveyor 114 is provided that seeks to convey the object 102 as it travels along the forward direction 150. Similar to the embodiment of FIG. 1, the wrapping device wraps both the object 202 and the intermediate conveyor 114, and the wrapping material 106 may be dragged backwards by virtue of the backwards movement of a lower bearing surface of the intermediate conveyor 114. Accordingly, similar issues arise in relation to a potentially damaged object 102 or wrapping material 106.

FIG. 5 is a side elevation view 500 of an improved wrapping device where a "pass through conveyor" mechanism is provided, according to some embodiments.

The improved wrapping device receives the object 202 on the conveyance mechanism 108 (e.g., an object conveyor) that conveys the object 202 in a forward direction (e.g., an object path). The improved wrapping device of FIG. 5, includes both the intermediate conveyor 114 but also has a wrapping material conveyor 116 that is configured to operate in an opposite direction than the conveyance mechanism 108. Accordingly, a bearing surface of the wrapping material conveyor 116 travels also in the forward direction 150.

The orbital wrapping device 104 (e.g., orbital wrapping mechanism) is configured to travel along the path 170 and deposits the wrapping material 106 around both at least a portion of the object 202 and at least a portion of the wrapping material conveyor 116, the wrapping material conveyor 116 having at least one bearing surface in contact with the stretch wrapping material and movable in a forward direction defined by the object path such that the stretch wrapping material is conveyed along the object in the forward direction.

The wrapping material conveyor 116 can a conveyor belt having a top side and a bottom side, the bottom side of the conveyor belt travelling in the forward direction and the top side of the conveyor belt travelling in a backward direction, the conveyor belt being configured to operate such that travel of the top side in the forward direction is substantially matched to the speed of travel of the object along the object path.

However, the wrapping material conveyor 116 can also be (a) rollers, (b) a low friction surface, and (c) treads.

In operation, when object 202 travels along the forward direction 150, the object 202 passes through the path 170. As it travels through the path 170, the orbital wrapping device 104 wraps both the object 202 and the bearing surface of the wrapping material conveyor 116 that travels also in the forward direction 150.

Accordingly, the wrapping material 106 is deposited around physical elements that are all travelling in the forward direction 150, and as a result, the wrapping material 106 also travels at or about the same speed in the forward direction 150. The wrapping material 106 in such an example does not encounter the same backwards "dragging" force as it otherwise would in the designs of FIGS. 1 and 4.

The wrapping material 106 is thus transited along with the package and an improved mechanism of operation is exhibited as the wrapping material 106, once deposited, is aligned with the object 202. As there is a reduced or eliminated "dragging" force, the wrapping material 106 may potentially encounter reduced physical stress. Accordingly, a wider variety of wrapping material 106 can be utilized (e.g., thinner, cheaper, with less resistance to tearing, shearing force), and a wider variety of applications can be thus affected. Further, a wider variety of object loads can be utilized in conjunction with the device depicted in FIG. 5 and accordingly as the object also may potentially experience reduced physical stress.

For example, it may be particularly undesirable to subject the object to significant forces in the forwards or backwards direction as such forces may cause items being wrapped by way of the object to shift (e.g., relative to a pallet or each other) and may cause downstream difficulties in transportation, usage, or ensuring that the protective qualities of the wrapping material 106 are maintained. For example, shifting objects or dragged wrapping material 106 could lead to a poorer fit or adherence of the wrapping material 106 ultimately on the object 202. Accordingly, insects, rain, dust, grease, etc., may become deposited onto the object 202 and cause undue deterioration and damage. Further, the risk of accidental damage, puncture, tearing, or ripping of the wrapping material 106 may be reduced.

In some embodiments, the intermediate conveyor 114 is part of the conveyance mechanism 118 (e.g., the intermediate conveyor 114 is simply the end of the conveyance mechanism 118 and not a separate conveyor).

FIG. 6 is a side elevation view 600 of the improved wrapping device of FIG. 5, but with the object 202 in a more advanced position relative to the forward direction 150, according to some embodiments. As illustrated in FIG. 6, the wrapping material 106 is deposited around both the object 202 and the wrapping material conveyor 116, and the object 202, following conveyance on the intermediate conveyor 114, encounters aperture 602.

Aperture 602 defines a terminal end of the wrapping material conveyor 116. The orbital wrapping device 104 deposits the wrapping material 106 around both the portion of object 202 and the portion of the wrapping material conveyor with sufficient tension such that the stretch wrapping material, upon passing a terminal end of the wrapping material conveyor, contracts to wrap the object.

The length of aperture 602 may be selected based on various considerations (e.g., overall length, bulk), and, in some embodiments, is at least of a minimal length such that the wrapping material 106 is able to have space to compress and adhere to the dimensions of the object 202, causing it to be wrapped. For example, resilient wrap may be used that is biased to resiliently compress itself (e.g., by way of elastic forces) and bind the object 202. In other embodiments, wraps that utilize external factors for causing binding can be utilized (e.g., heat shrink wrap). When the object 202 reaches exit conveyor 110, it is tightly bound by wrapping material 106. Accordingly, exit conveyor 110 conveys along its bearing surface a wrapped object.

FIG. 7 is a cross sectional view 700 of the improved wrapping device of FIG. 5, taken along lines A-A, according to some embodiments. In this cross-sectional view, the orbital wrapping device 104 is shown as wrapping material roll 702 (other depositing mechanisms other than a roll are possible) that deposits wrapping material 106 as it travels along path 170. In this example, path 170 is an ellipse and the roll 702 travels in a counter-clockwise path (although clockwise paths are possible).

In FIG. 7, bearing surfaces 704, 706, 710, and 712 are depicted, and these are various bearing surfaces corresponding to the wrapping material conveyor 116 and the intermediate conveyor 114. The intermediate conveyor 114 is held in place by a frame 714, and it is important that wrapping material 106 does not contact either the frame 714 or the bottom bearing surface 712 of the intermediate conveyor 114 as it otherwise would be dragged backwards.

The wrapping material conveyor 116 in this example are provided by a pair of conveyors 704 and 706 and are shown to be oriented diagonally and each having opposite bearing surfaces, a first bearing surface that is moving towards the page (e.g., in the direction of travel of object 202), and a second bearing surface that is moving away from the page (e.g., opposite to the direction of travel of object 202). The bearing surfaces are oriented such that only the corresponding surfaces that move in the direction of travel of object 202 contact wrapping material 106.

In this configuration, the first conveyor 704 and the second conveyor 706 are positioned to flank the intermediate conveyor 114 on opposite sides of the intermediate conveyor 114 . The positioning to flank the intermediate conveyor 114 aids in biasing the wrapping material 106 away from the frame 714. In some embodiments, the distance away from the frame 714 (e.g., a clearance distance) can be modified based on the material strength of the wrapping material 106.

Variations to the orientation and positioning of the wrapping material conveyor 116 are contemplated. As depicted in the example of FIG. 7, angles 716 and 718 are illustrated wherein the wrapping material conveyor 116 is oriented diagonally relative to a vertical plane. In the course of Applicants' testing, an angle of about 15 degrees outwards (e.g., within a range of +/−1 degree, +/−2 degrees, +/−3 degrees, or variants and combinations thereof) was found to be a preferred angle for orienting the wrapping material conveyor 116. The angle of the conveyors 704 and 706 was found to aid in the reduction of the overall distance 708 from the top of the object 202.

In some embodiments, the wrapping device is configured to minimize or otherwise reduce the distance 708 such that the wrapping material 106 does not have a large travel distance once it reaches the aperture 602 to bind tightly to the object 202. A larger distance 708 requires more compression of the wrapping material 106, and a reduced distance 708 may allow for cheaper, less strong wrapping material 106 to be used to achieve a suitable outcome.

In an alternate embodiment, the wrapping material conveyor 116 may be a single conveyor that is positioned alongside the bottom of intermediate conveyor 114. The wrapping material conveyor is adapted such that the bottom bearing surface travels in the forward direction (e.g., at the same or about the same speed as object 202).

In the alternate embodiment, the wrapping material 106 is similarly deposited around both the object 202 and the bearing surface of the wrapping material conveyor 116 such that the wrapping material 106 also travels in the forward direction along with object 202. When aperture 602 is reached (e.g., the end of the intermediate conveyor 114 and the wrapping material conveyor 116), the wrapping material 106 may then either without intervention or with intervention be adapted to cling tightly with object 202.

The wrapping device is utilized in a variety of contexts. For example, there is application in the military, storage, transport, building industries, and the wrapping device is an important contributor in an effective and efficient logistics process.

The wrapping device may be designed to interoperate with a variety of other machinery, such as in-feed processors, out-feed processors, etc. The wrapping device may be an intermediate device in an overall system wherein a finished good or product is created. For example, a building supply manufacturing factory may prepare steel girders that are fed into the wrapping device for binding into extra-long packages on pallets that are then shipped to building sites. In this example, a tight binding may be helpful in allowing the pallets to be stored outdoors where they may be exposed to rain, sun, etc., and the wrapping material keeps out the elements. There may be many loose objects that are packaged altogether in singular loads.

In some embodiments, the wrapping device may include one or more control systems and the positioning and orientation of the wrapping mechanisms and conveyors may be controlled in accordance with various inputs, either automatic or manual. For example, the conveyors may be adapted for movement and orientation taking into consideration distance 708 for different types of wrapping materials 106 (e.g., if a material is not very "stretchy", distance 708 may need to be reduced), and the control systems and circuitry may modify various aspects and factors such as speed of travel along direction 150, the speeds of operation of each of the conveyors, etc. The length of aperture 602 may be modified in some instances, and similarly, the speed of rotation of the orbital wrapping device 104, the path 170, among others, can be modified. These control systems may receive operator inputs or read serial numbers or other encoded information on the wrapping material 102, and/or the objects 202 themselves. These inputs can be utilized to automatically gauge and modify how the system operates by way of the control systems. In some embodiments, the control systems may operate responsive to sensed characteristics of the wrapping materials 106 or objects 202 (e.g., detecting potential damage conditions).

Accordingly, the embodiments of the devices, systems and methods described herein may be implemented in a combination of both hardware and software, or hardware individually. Control systems may be implemented on programmable computers, each computer including at least one processor, a data storage system (including volatile memory or non-volatile memory or other data storage elements or a combination thereof), and at least one communication interface. Program code may be applied to input data to perform the functions described herein and to generate output information.

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be exemplary only.

What is claimed is:

1. A device for wrapping an object resting on an object conveyor defining an object path, the object conveyor conveying the object in a forward direction along the object path, the device comprising:

a wrapping material conveyor configured for cooperation with the object conveyor, the wrapping material conveyor positioned beneath the object conveyor such that when a stretch wrapping material travels along an elliptical path around the object path, the stretch wrapping material is deposited around both at least a portion of the object and at least a portion of the wrapping material conveyor, the wrapping material conveyor comprising a first conveyor belt and a second conveyor belt positioned to flank the object conveyor on opposite sides of the object conveyor;

wherein each of the first conveyor belt and the second conveyor belt include a first bearing surface travelling in the forward direction and a second bearing surface travelling in a backward direction;

wherein the first conveyor belt and the second conveyor belt are oriented such that only the corresponding first bearing surfaces contact the stretch wrapping material; and wherein the first conveyor belt and the second conveyor belt are angled relative to a vertical axis such that corresponding bottom sections of the first conveyor belt and the second conveyor belt are angled away from the object conveyor.

2. The device of claim 1, wherein the stretch wrapping material is deposited around both the portion of the object and the portion of the wrapping material conveyor with sufficient tension such that the stretch wrapping material, upon passing a terminal end of the wrapping material conveyor, contracts to wrap the object.

3. The device of claim 1, wherein the wrapping material conveyor and the object conveyor together form an intermediate conveyor that is adapted for use in cooperation with an in-feed conveyor, the in-feed conveyor conveying the object to the intermediate conveyor for wrapping.

4. The device of claim 2, further comprising an aperture following the terminal end of the wrapping material conveyor; and wherein the stretch wrapping material contracts to wrap solely the object within the aperture prior to the wrapped object engaging an exit conveyor that conveys the wrapped object to a downstream destination.

5. The device of claim 1, wherein the first conveyor belt and the second conveyor belt are both angled away at about 15 degrees from the vertical axis.

6. A system for wrapping an object, the system comprising:

an in feed conveyor;

an object conveyor adapted to receive the object from the in feed conveyor, the object conveyor defining a wrapping material conveyor configured for cooperation with the object conveyor, the wrapping material conveyor positioned beneath the object conveyor such that when a stretch wrapping material travels along an elliptical path around the object path, the stretch wrapping material is deposited around both at least a portion of the object and at least a portion of the wrapping material conveyor, the wrapping material conveyor comprising a first conveyor belt and a second conveyor belt positioned to flank the object conveyor on opposite sides of the object conveyor, wherein each of the first conveyor belt and the second conveyor belt include a first bearing surface travelling in the forward direction and a second bearing surface travelling in a backward direction, wherein the first conveyor belt and the second conveyor belt are oriented such that only the corresponding first bearing surfaces contact the stretch wrapping material, and wherein the first conveyor belt and the second conveyor belt are angled relative to a vertical axis such that corresponding bottom sections of the first conveyor belt and the second conveyor belt are angled away from the object conveyor; and an exit conveyor configured to receive a wrapped object from the object conveyor and to provide the object to one or more downstream devices.

7. The system of claim 6, wherein the stretch wrapping material is deposited around both the portion of the object and the portion of the wrapping material conveyor with sufficient tension such that the stretch wrapping material, upon passing a terminal end of the wrapping material conveyor, contracts to wrap the object.

8. The system of claim 7, further comprising an aperture following the terminal end of the wrapping material conveyor; and wherein the stretch wrapping material contracts to wrap solely the object within the aperture prior to the wrapped object engaging the exit conveyor that conveys the wrapped object to a downstream destination.

9. The system of claim 6, wherein the first conveyor belt and the second conveyor belt are both angled away at about 15 degrees from the vertical axis.

10. A method for wrapping an object resting on an object conveyor defining an object path, the object conveyor conveying the object in a forward direction along the object path, the method comprising:

providing a wrapping material conveyor positioned proximate the object conveyor, the wrapping material conveyor configured for cooperation with the object conveyor and positioned beneath the object conveyor and comprising a first conveyor belt and a second conveyor belt positioned to flank the object conveyor on opposite sides of the object conveyors; and depositing, the stretch wrapping material around both at least a portion of the object and at least a portion of the wrapping material conveyor, the stretch wrapping material being conveyed along with the object in the forward direction;

wherein each of the first conveyor belt and the second conveyor belt include a first bearing surface travelling in the forward direction and a second bearing surface travelling in a backward direction, wherein the first conveyor belt and the second conveyor belt are oriented such that only the corresponding first bearing surfaces contact the stretch wrapping material, and wherein the first conveyor belt and the second conveyor belt are angled relative to a vertical axis such that corresponding bottom sections of the first conveyor belt and the second conveyor belt are angled away from the object conveyor.

* * * * *